United States Patent [19]

Mills

[11] Patent Number: 4,617,977

[45] Date of Patent: Oct. 21, 1986

[54] CERAMIC CASTING MOULD AND A METHOD FOR ITS MANUFACTURE

[75] Inventor: David Mills, Bristol, England

[73] Assignee: Rolls-Royce Limited, London, England

[21] Appl. No.: 509,812

[22] Filed: Jun. 30, 1983

[30] Foreign Application Priority Data

Jul. 3, 1982 [GB] United Kingdom ..... 8219293

[51] Int. Cl.[4] ..... B22C 9/00; B22C 9/04

[52] U.S. Cl. ..... 164/30; 164/34; 164/35; 164/361; 164/522

[58] Field of Search ..... 164/28.30, 34–36, 164/122.1, 122.2, 361, 520, 522, 397, 398, 399; 53/442

[56] References Cited

U.S. PATENT DOCUMENTS

| | | | |
|---|---|---|---|
| 2,793,412 | 5/1957 | Lashbrook | 164/34 |
| 2,875,485 | 3/1959 | Schneider | 164/35 |
| 3,596,703 | 8/1971 | Bishop | 164/30 |
| 4,043,379 | 8/1977 | Biazek | 164/23 |
| 4,066,116 | 1/1978 | Blazek et al. | 164/17 |
| 4,068,702 | 1/1978 | Herold | 164/122.1 |
| 4,108,931 | 8/1978 | Ogden | 164/36 |
| 4,129,169 | 12/1978 | Biedacha et al. | 164/166 |
| 4,133,371 | 1/1979 | Birch et al. | 164/364 |
| 4,421,153 | 12/1983 | Wilkinson et al. | 164/35 |

FOREIGN PATENT DOCUMENTS

| | | | |
|---|---|---|---|
| 720301 | 10/1965 | Canada | 164/35 |
| 873723 | 6/1971 | Canada | 53/442 |
| 2651144 | 5/1977 | Fed. Rep. of Germany . | |
| 2900959 | 7/1979 | Fed. Rep. of Germany . | |
| 51-37820 | 3/1976 | Japan | 164/34 |
| 1093726 | 12/1967 | United Kingdom . | |
| 1135255 | 12/1968 | United Kingdom . | |
| 1346576 | 2/1974 | United Kingdom . | |
| 2012640A | 1/1979 | United Kingdom . | |
| 2028928A | 7/1979 | United Kingdom . | |
| 1584367 | 2/1981 | United Kingdom . | |
| 2096502A | 10/1982 | United Kingdom . | |
| 2096503A | 10/1982 | United Kingdom . | |

*Primary Examiner*—Nicholas P. Godici
*Assistant Examiner*—Richard K. Seidel
*Attorney, Agent, or Firm*—Parkhurst & Oliff

[57] ABSTRACT

The present invention provides a method for manufacturing a thin-walled ceramic casting mould which is particularly suitable for casting directionally solidified articles in which rapid cooling of the cast material is required. The mould is transfer moulded around a disposable pattern material and includes an integral core. The mould has an outer wall thickness of the order of 0.5 mm to 2.0 mm. The mould and core may be made of the same or different ceramic materials chosen for their strength or thermal conductivity. The method further provides for a series of high temperature disposable supports embedded in the disposable pattern material, providing support for the outer wall of the mould during the firing process. The disposable supports are disposed of at a temperature at which the mould has acquired self-supporting strength.

15 Claims, 7 Drawing Figures

CERAMIC CASTING MOULD AND A METHOD FOR ITS MANUFACTURE

The present invention relates to a ceramic casting mould and a method for its manufacture.

A widely used process of making moulds is the lost wax process in which a wax pattern of the article to be made is made and is repeatedly invested with particulate ceramic material until the required mould thickness has been built up. One drawback found with this process is that the repeated investment of the pattern produces a layered structure in the ceramic. Another drawback is that the binder used in the ceramic slurry is invariably silica-based, which limits the overall refractoriness of the shells produced to the extent that distortion occurs at the high temperatures used in casting directionally solidified articles.

In our U.K. Pat. No. 1,584,367 there is described a mould arrangement for casting metal articles in which each mould is made directly in ceramic material by a transfer moulding technique.

Moulds made by the injection moulding technique, particularly those of complex internal shape, are made in two or more parts to minimise the complexity of the dies used. This has the advantage that they can be inspected easily before casting, but has the disadvantage that the parts have to be clamped or cemented together before pouring of the casting takes place. In the process described in the above mentioned patent, a plurality of moulds made in parts are held together in an assembly by ceramic covers or a strap encircling the assembly. Another disadvantage is that where a cement is used, the mould parts have to be made with flanges to provide sufficient surface to which the cement can be applied.

When casting directionally solidified articles, which term includes single crystal articles, the higher temperatures involved make it desirable to have homogeneous moulds which have no bulky joints, and it is also desirable that the moulds should be strong, thin-walled, and have high thermal conductivity. All of these requirements have hitherto not been achieved simultaneously by either of the above-described known processes for making casting moulds.

One object of the present invention is to provide a mould defining a casting cavity and which is of thin-walled seamless, homogeneous construction at least in its casting cavity-defining portions. The term "thin-walled" is meant to include moulds having wall thicknesses of the order of 0.5 mm to 2.0 mm thick.

Another object of the present invention is to provide a method for the manufacture of such a mould.

The invention as claimed herein fulfils these objects in that it uses as an essential feature of the manufacturing process for the mould, the step of injection moulding a ceramic material around a disposable pattern. The injection moulding step produces a homogeneous mould structure and allows the use of higher strength ceramic materials that have not hitherto been used with the lost wax process. At the same time injection into a die enclosing a disposable pattern enables seamless moulds to be produced. This in turn enables the mould walls to be made thinner and by choosing a high strength ceramic material which also has a high thermal conductivity, a significant increase can be achieved in the cooling rate of the mould, which reduces the cost of the casting process, particularly where a directionally solidified article is being produced.

By including in the method of manufacture some or all of the additional steps claimed, further advantageous results can be achieved. For example, the method can be used to produce a mould with an integrally formed core very accurately located in it. This can be achieved if an injection moulded core made from the same material as the ceramic material of the mould and cured into its green state is embedded in the disposable pattern. By this means when the mould is fired, the core and the mould will undergo the same amount of shrinkage so that there will be no relative changes in dimension between the two.

Further, if the mould is supported on its inner and outer wall surfaces during firing of the ceramic, distortion of the walls of the mould can be minimised.

The invention will now be more particularly described, by way of example only, with reference to the accompanying drawings in which.

Figure 1:
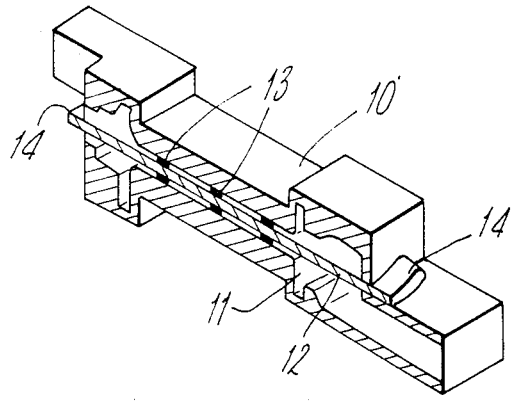
FIGS. 1 to 5 illustrate longitudinal sections through a mould of the present invention at various stages of manufacture, and, FIG. 6 illustrates a mould assembly prepared for firing.

Referring now to the drawings, there is shown in FIG. 1 a die 10 having a cavity 11 in which is positioned a pre-formed alumina core 12. The internal surfaces of the die are shaped to produce an accurate pattern of the article to be cast, in this example, a stator vane for a gas turbine engine. The core is supported adjacent its ends and edges in the die leaving end and edge portions 14 and 15 exposed, so that they will not be encapsulated by the material being injected into the die.

The core may be pre-fired, in which case its strength may be such that no additional support is necessary. In the preferred method, however, the core is only cured to its "green" state and is preferably also located against movement or distortion during the injection process by high temperature disposable chaplets 13.

The description "high temperature" as applied to the chaplets means, as will be seen later, that they must be made from a material which retains its strength during the firing of the ceramic mould and core up to a temperature at which the ceramic has acquired sufficient strength not to require further support. Beyond that temperature, but at a temperature less than the final sintering temperature of the ceramic, the chaplets must burn out of the finished mould.

It is also preferable that the material used for the chaplets has a shrinkage compatible with that of the ceramic at least up to the self-supporting temperature of the ceramic. One type of material which fulfils all of the these requirements is a phenol formaldehyde thermosetting resin containing a graphite filler.

Figure 2:
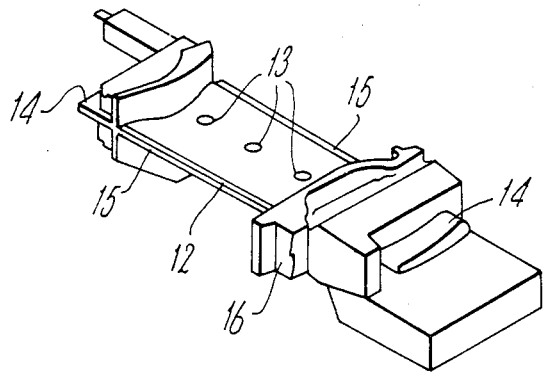

The next step of the method is the injection of the disposable material into the cavity 11, thereby encapsulating the main bulk of the core 12 and the chaplets 13 to form the pattern, but leaving the end and edge portions 14 and 15 of the core exposed. FIG. 2 shows the pattern 16 after removal from the die 10.

Figure 3:
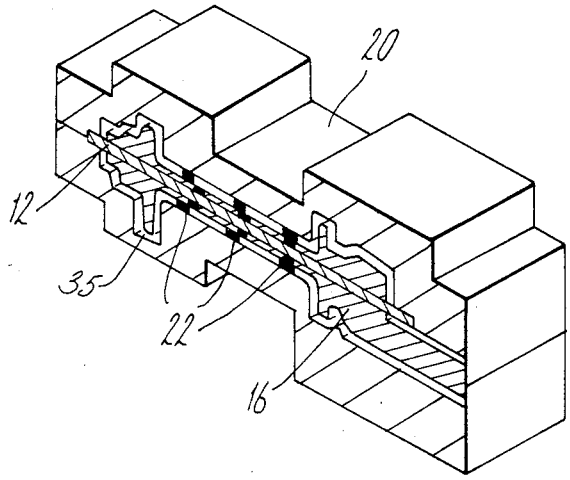

The pattern 16 is then placed in a further die 20, shown in FIG. 3, for the final part of the process, which is the injection of the ceramic material to form the mould. The pattern 16 is supported at its ends, but additional high temperature chaplets 22 are provided along its length to prevent any movement during the injection process. Ceramic material is injected into the space 35 defined within the die by the disposable pattern, and once set into its so-called "green" state the mould is removed from the die.

To allow for differential thermal expansions, all but one of the exposed portions 14 and 15 of the core are painted with a polystyrene paint which burns away during firing of the mould. Thus only one of the embedded portions becomes integrally fixed to the mould, the others remaining free to slide.

Figure 4:
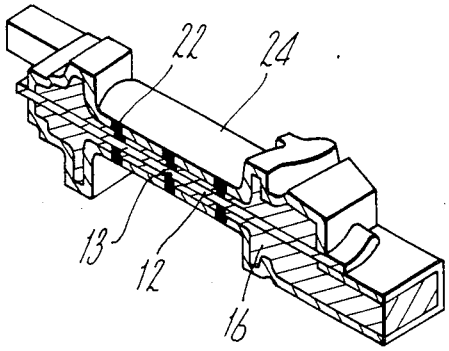
Figure 5:
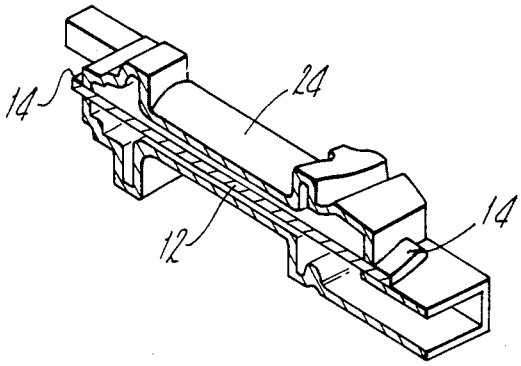

FIG. 4 shows the mould at this stage, and all that remains to be done is to remove the disposable pattern 16 and fire the ceramic and core to produce the finished mould which is shown in FIG. 5.

Depending on the material used as the disposable pattern, it may be removed by melting, burning, dissolution or in any other suitable manner. Where heat is required to remove it, this step of the process may be carried out as part of the firing step. For reasons to be explained below it is preferable that the pattern be removed in a pre-heating step before the mould is fired.

Because the mould walls are thin it is preferable to provide support for them to prevent distortion during the firing step. A preferred manner of doing this is to form as assembly of truncated wedge-shaped spacers, each having a shaped recess in one or both faces thereof into which the moulds are fitted. The recesses are shaped to provide areas of contact at various points along the length of the mould outer surface. When assembled the wedge-shaped spacers may be arranged to define a cylindrical or polygonal assembly.

Figure 6:
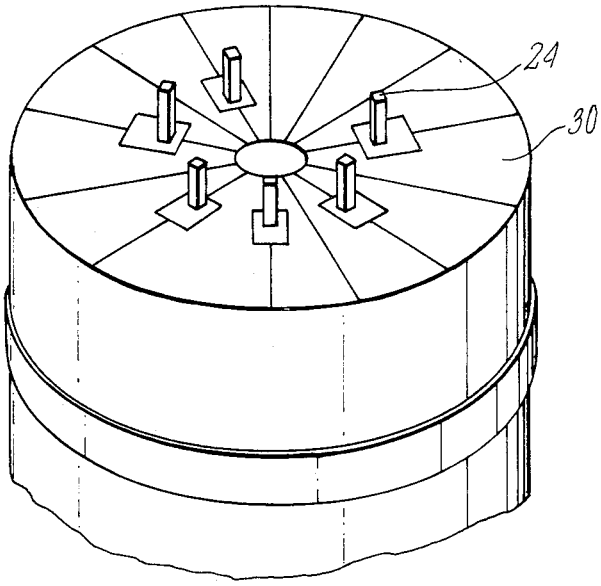

FIG. 6 shows such a cylindrical assembly of moulds 24 and spacers 30. The spacers should be made of a material which has a shrinkage rate on firing which is compatible with that of the "green" ceramic, and may be made from the same "green" ceramic material.

Figure 7:
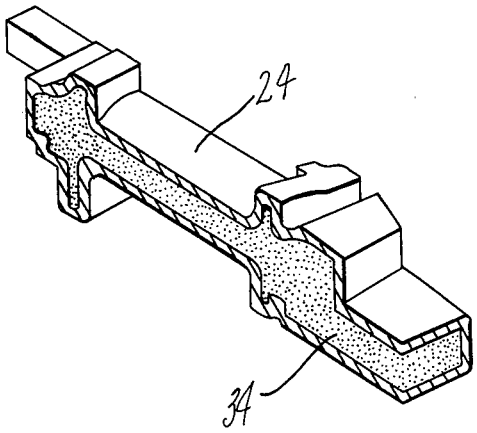
FIG. 7 illustrates a longitudinal section through a mould of the present invention showing an alternative embodiment for supporting the outer mould wall during firing.

The firing step is preferably carried out in accordance with the method described in the specification of our copending patent application No. 81,11223, now published as British Application No. 2,096,502, filed Oct. 20, 1982. In accordance with that method the cylindrical assembly is bound with a refractory tape which shrinks on heating to a greater degree than the ceramic parts of the assembly. Thus on firing, the tape pulls the truncated wedges tightly together causing the side-faces of the spacers to provide good support for the walls of the mould. The ceramic moulds and cores in their green state have a degree of flexibility and, during the early part of the firing step, any distortions will be straightened out by the pressure from the spacers.

Where the mould is formed with an integral core, as described above, the graphite spacers will support the walls of the mould from inward distortion until the temperature is reached at which they burn out. If the mould is made without a core, however, it is preferable to provide support on the inside of the mould, and this can be done by filling the mould with a non-sintering ceramic powder, for example re-crystallised alumina 34, as shown in FIG. 7, or by supports positioned at different places within the mould cavity. In the latter case, the supports may conveniently be provided by embedding in the disposable pattern, pins made from a high temperature disposable material, for example, the graphite supported resin hereinbefore described. These will remain in place when the disposable material is removed but will burn out before the highest sintering temperature of the ceramic is reached.

Turning now to the materials to be used in the method described above, one of the advantages of the present invention is that it allows a much wider choice for the ceramic material of the mould than the lost wax process. Thus the ceramic material may be a conventional silica composition or one of the higher strength ceramics, such as alumina or zirconia may be used.

The ceramic material is mixed with a resin binder for the injection process. The binder may be a thermo-plastic resin which, on injection into a cold die, sets solid, but which softens again on heating. Using such resins the disposable pattern may be a conventional wax pattern.

In order to take advantage of the benefits of firing the ceramic in a cylindrical assembly, as described above, we prefer to use a thermo-setting resin, which is injected into a hot die and cured. Such resins once cured retain their strength during the early part of the firing process and do not soften again. Of course, a mixture of the two types of resin may be used provided adequate strength is maintained.

When using thermosetting resin binders, the disposable pattern material must be capable of withstanding the temperature and pressure during the injection of the ceramic material without deformation, but must be capable of being removed by a relatively simple process, for example, burning, melting or dissolution. A preferred material is a water soluble organic compound, for example, cane sugar which retains adequate strength to beyond 150° C., which is the usual injection temperature of the ceramic using a thermosetting resin binder.

The cane sugar contains an inert filler such as mica or slate powder, but preferably a soluble filler is used, for example, ammonium chloride and it may contain effervescing agents. Alternatively some low melting point metal alloys may be used, for example, those tin-zinc alloys sold under the Trade names of CERROBENT or CERROTRUE.

The chaplets 22 for supporting the pattern 16 in the die 20 must also withstand the pressure and temperature of the injection process. However, since these spacers span the space 24 into which the ceramic is injected, they are preferably made from the same material as the ceramic material being injected but which has previously been cured to its green state. We have found that during the injection process the ceramic integrates with the pieces of the same material cured to the green state to such an extend that the pieces become absorbed into a homogeneous mass without leaving any areas of weakness. These supports thus become part of the mould itself.

The core material need not be alumina but is selected in dependence on the requirements of the casting process. Thus silica or any other known core material may be used. However, another particular advantage of the invention is that the core and mould can be made from the same ceramic material in the same thermosetting resin binder. When injected hot, the binder cures to the green state which has intermediate strength and some flexibility. The mould with its core and supports can all be fired together at the same temperature and there will be no distortion due to differential thermal expansions or differential shrinkage. Thus the core remains accurately positioned within the final mould.

The high temperature chaplets 13 may, as an alternative to the graphite compound, be made from a metal compatible with that being cast, and which can be allowed to dissolve in the casting rather than being burned out as the graphite spacers are.

It will be appreciated that the above-described process enables a core to be accurately located in a mould which is itself made by a transfer moulding technique, so that none of the accuracy provided by the injection process of mould manufacture is lost.

One advantage of the above-described process over the conventional lost wax process is that the ceramic from which the mould is made can be accurately injected to give a very thin homogeneous wall thickness. This enables high heat conductivity to be achieved which speeds up the cooling process after casting. The homogeneous material is of uniform cross-section and is not subject to flaking or cracking as is the conventional invested shell mould. Because of the choice of materials available with this process, a material having the most beneficial combination of strength and thermal conductivity can be chosen depending on the casting process being used. Clearly the mould can have a varying wall thickness if desired.

In order to make a mould without a core, the process is simplified by the elimination of the first step. A disposable article is made without the core and is supported in a die as described above while ceramic is injected around it.

The mould described above may form part of a larger multiple mould assembly made completely by an injection process, thus eliminating the need for the time-consuming lost wax investment process currently used for making multiple moulds for casting aerofoil blades in the aero engine industry.

The mould shown in the example described above is open-ended ready for connection to a runner system in such a larger assembly. However, individual moulds with their own runner and riser systems can also be made by the method of the invention.

I claim:

1. A method of making a seamless ceramic casting mould with a thin outer wall comprising the steps of:

making a first die, at least a part of which defines the shape of an article to be cast, providing within the die one or more high temperature disposable supports which support the thin outer mould wall during the firing process but which are disposable at a temperature at which the thin outer mould wall has acquired self-supporting strength, filling the die with a disposable pattern material whereby the supports become embedded in the pattern material, and allowing the pattern material to set, removing the disposable pattern from the first die and inserting it into a second die, the inner surface of which is dimensioned to conform generally with the outer surface of at least the article-defining part of the pattern and to define a space therewith which conforms to the required thickness of the outer wall of the mould, providing supports between the pattern and the die which are made from a ceramic material, injecting a ceramic material under pressure into the space and allowing it to set to form the outer wall of the ceramic casting mould, the inner surface of such outer wall defining the outer surface of the article to be cast, removing the disposable pattern from within the mould and firing the mould.

2. A method as claimed in claim 1 and wherein the step of firing the ceramic includes the additional steps of:

making an assembly of moulds in their pre-fired condition together with spacer members of generally truncated wedge shape placed alternately between them, the spacer members being made of a material having a shrinkage rate on heating which is compatible with that of the mould material, holding the assembly tightly together in a cylindrical or polygonal array whereby the spacers provide support for the external walls of the moulds during firing, and firing the assembly of moulds and spacers together.

3. A method as claimed in claim 2 and wherein the assembly is held together by means of a ceramic tape wound around it, and which shrinks at a greater rate than the materials of the ceramic and spacers on heating, whereby the array of moulds and spacers is pulled together to take up any shrinkage on heating.

4. A method as claimed in claim 1 and in which the step of injecting ceramic material into the die includes the further steps of mixing the ceramic material with a thermosetting resin binder, heating the die and injecting the ceramic material mixture into the heated die.

5. A method as claimed in claim 1 and in which the ceramic material is chosen from silica alumina or zirconia.

6. A method as claimed in claim 1 and in which the disposable material is a low melting point metal.

7. A method as claimed in claim 1 and in which the disposable material is a water soluble organic compound.

8. A method as claimed in claim 7 and in which the water soluble organic compound is cane sugar.

9. A method as claimed in claim 8 and in which the cane sugar includes a filler material.

10. A method as claimed in claim 1 and comprising the additional step of providing a core within the disposable material which remains in the mould when the disposable material is removed whereby hollow articles can be cast in the mould.

11. A method as claimed in claim 10 and wherein the core is provided by the steps of locating the core in a die, the internal surfaces of which define the shape of the article to be cast, but leaving end and edge portions of the core exposed, and injecting the disposable material into the die.

12. A method as claimed in claim 11 and in which the core is supported in the die by high temperature chaplets.

13. A method as claimed in claim 10 and in which the core is itself transfer mould and cured to its green state, the core being fired during the firing of the mould.

14. A method as claimed in claim 13 and in which the core is made from the same material as the mould.

15. A method of making a seamless ceramic casting mould with a thin outer wall comprising the steps of:

making a first die, at least a part of which defines the shape of an article to be cast, filling the die with a disposable pattern material and allowing the pattern material to set, removing the disposable pattern from the first die and inserting it into a second die, the inner surface of which is dimensioned to conform generally with the outer surface of at least the article-defining part of the pattern and to define a space therewith which conforms to the required thickness of the outer wall of the mould, providing supports between the pattern and the die which are made from a ceramic material, injecting a ceramic material under pressure into the space and allowing it to set to form the outer wall of the ceramic casting mould, the inner surface of such outer wall defining the outer surface of the article to be cast, removing the disposable pattern from within the mould, filling the hollow mould with a non-sintering ceramic powder to provide support for the inner surface of the outer mould wall during the firing step, and firing the mould.

* * * * *